United States Patent [19]

Krall et al.

[11] 4,323,900

[45] Apr. 6, 1982

343/700MS

[54] OMNIDIRECTIONAL MICROSTRIP ANTENNA

[75] Inventors: Albert D. Krall, Rockville; John W. McCorkle, College Park; John F. Scarzello, Columbia; Albert M. Syeles, Silver Spring, all of Md.

[73] Assignee: The United States of America as represented by the Secretary of the Navy, Washington, D.C.

[21] Appl. No.: 80,596

[22] Filed: Oct. 1, 1979

[51] Int. Cl.[3] ..... H01Q 1/38

[52] U.S. Cl. ..... 343/700 MS; 343/895

[58] Field of Search ..... 343/700 MS, 895, 846, 343/829, 830

[56] References Cited

U.S. PATENT DOCUMENTS 4,204,212 5/1980 Sindoris et al. ..... 343/895

*Primary Examiner*—David K. Moore

[57] ABSTRACT

An electrically short, omnidirectional antenna formed with a strip conductor helically wound about the outside of a cylindrical ground plane. A layer (ideally, a very thick layer) of a nonconducting material preferably with a low dielectrical constant (i.e., $\epsilon_r \simeq 1.0$) separates the microstrip from the ground plane.

8 Claims, 6 Drawing Figures

OMNIDIRECTIONAL MICROSTRIP ANTENNA

BACKGROUND OF THE INVENTION

This invention relates to antennae and more particularly, to omnidirectional microstrip antennae.

A short, vertical rod is the classic omnidirectional antenna. It is omni-directional in a plane perpendicular to its longitudinal axis, vertically polarized in that plane, and may be easily matched with the impedance of ancillary equipment stages. Characteristically, a vertical rod is inefficient, does not remain tuned when placed in different media of radiation, and is particularly sensitive to nearby sensors, oscillators, and transmitters. While two orthogonal vertical loops may be used to provide the proper pattern (i.e., omnidirectional) and desired polarization, interactions between loops detracts from the performance of the antenna. Also, efficiency is low when loops are small compared to the operating wavelength. The noun "ground plane" denotes a conducting or reflecting plane functioning to image a radiating structure.

SUMMARY OF THE INVENTION

An electrically short, omnidirectional antenna formed by a quarter wavelength of strip conductor helically wound about the exterior cylindrical surface of a hollow dielectric cylinder. An electrical conductor disposed about one base of the dielectric cylinder couples the strip conductor with a ground plane formed by a coating of an electrically conducting material covering the interior circumferential surface.

Accordingly, it is among the objects of the invention to provide an antenna that is efficient.

It is a second object to provide an antenna that is omnidirectional in a plane.

It is another object to provide an antenna that is omnidirectional in a plane and vertically polarized in that plane.

It is yet another object to provide an antenna that is insensitive to detuning when placed in a different medium of radiation.

It is still another object to provide an antenna that is easily matched to the impedance of an adjoining electronic stage.

It is still yet another object to provide an electrically short antenna.

It is still a further object to provide an antenna structure able to give a desired bandwidth through change of material constants.

BRIEF DESCRIPTION OF THE DRAWINGS

A more complete appreciation of this invention and the many attendant advantages thereto will be readily enjoyed as the same becomes better understood by reference to the details of the following description when considered in conjunction with the accompanying drawings in which numbers indicate the same or similar components, wherein.

DETAILED DESCRIPTION OF THE EMBODIMENTS

Figure 1:
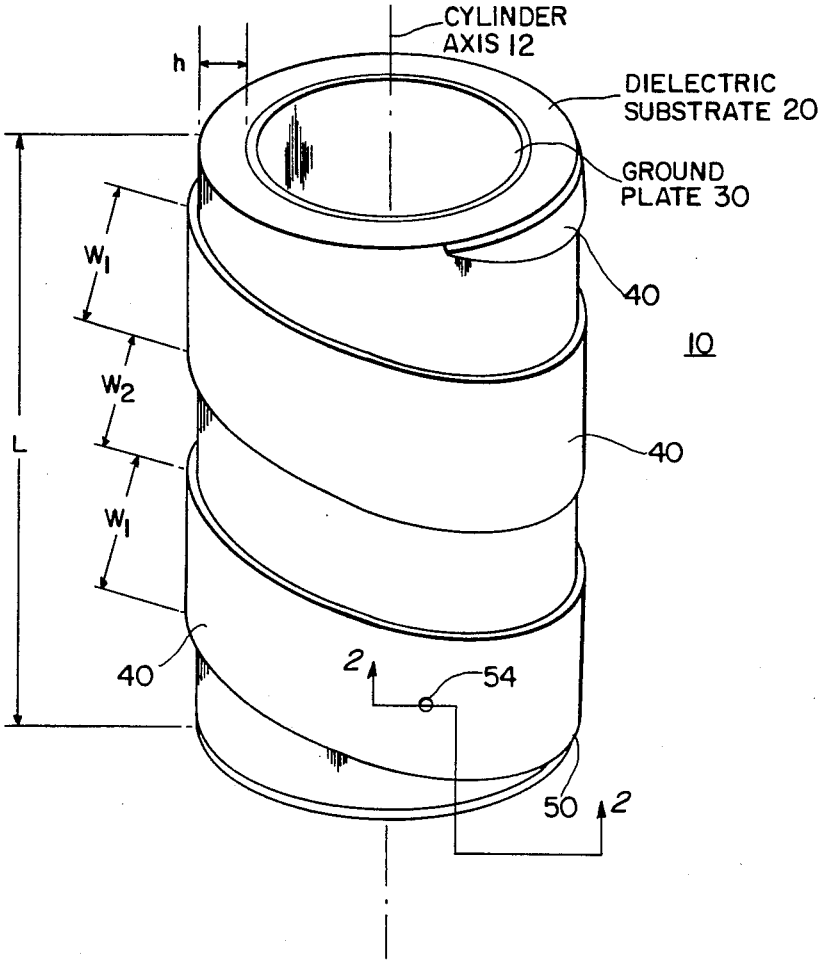
FIG. 1 is a pictorial view of an omni-microstrip antenna made according to these teachings.

Referring now to the drawings, and in particular to FIG. 1, a pictorial view illustrates an one embodiment of an omni-microstrip antenna—an electrically short antenna. An "electrically short antenna" is one with a maximum linear dimension in any direction not greater than one eighth of the operating wavelength, $\lambda_g$, where:

$$\lambda_g = \lambda_o/\epsilon_r' \tag{1}$$

and:

$\epsilon_r'$ is the effective dielectric constant of the substrate material relative to air, $\lambda_o$ is the resonant wavelength of the antenna.

Figure 1A:
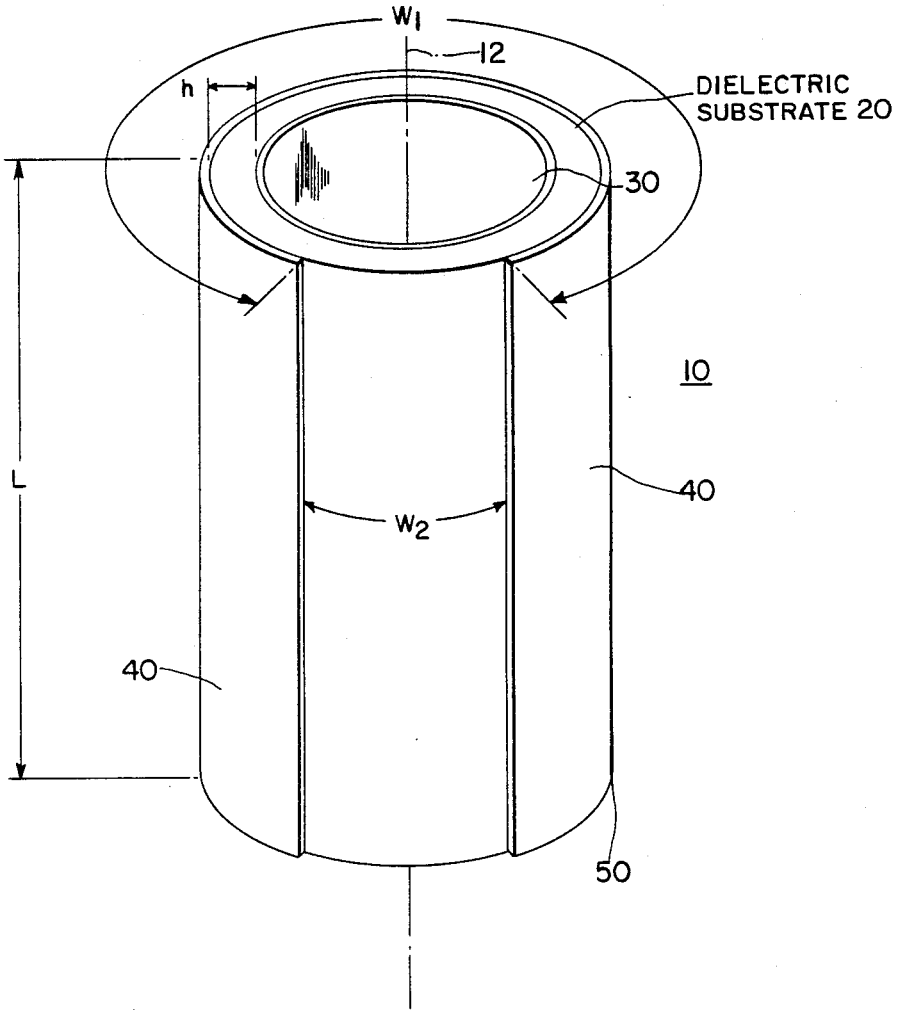
FIG. 1A is a pictorial view of an alternate embodiment of an omni-microstrip antenna.

An omni-microstrip antenna suitable for any frequency from audio through the infrared bands (i.e., 20 Hertz through $10^{12}$ Hertz) is essentially a shorted quarter wavelength microstrip resonator as shown in FIG. 1. Antenna 10 is made from a hollow right circular cylindrical substrate 20 of a nonconducting material (e.g., polyvinylchloride, polystyrene), preferably a material with a low dielectric constant. A coating of an electrically conducting material (e.g., electroplated copper) at least several skin depths thick at the operating frequency is helically wound about the exterior circumferential surface of substrate 20, defining strip conductor 40. The strip conductor 40 is conveniently made uniform in width, $W_1$, and separation, $W_2$, between adjacent loops. In a preferred arrangement, the separation $W_2$, between adjacent equals one-half the width of strip conductor 40. The length of strip conductor 40, whether measured along an edge or the centerline, equals one-fourth of the resonant wavelength. As shown in FIG. 1, the strip conductor completes slightly more than two turns, an omnidirectional radiation pattern is provided if strip conductor 40 completes slightly more than one turn about the circumference of substrate 20. As shown in FIG. 1A, strip conductor 40 may be merely an electrical strip conductor 40 that is $\lambda_g/4$ wide and wound two-thirds of the way around the circumference of the exterior circumferential surface of a right circular cylindrical substrate 20. The edges of strip conductor 40 are parallel to the bases of cylindrical substrate 20. The axial length of substrate 20 is about equal to $\lambda_g/4$ and less than $\lambda_o/8$. Preferably, $\lambda_g << \lambda_o$. As $\lambda_o > 2\lambda_g$ and $\lambda_o = \lambda_g\sqrt{\epsilon_r'}$, then $\epsilon_r' > 4$. The width, $W_1$, of strip conductor 40 must be less than $\lambda_g/2$.

$$W_1 < \frac{\lambda_g}{2} \tag{2}$$

$$W_1 \cong \frac{2C}{3} = \frac{\pm 2\pi D}{3} \tag{3}$$

where D is the diameter of the loop formed strip conductor 40. Therefore, $$D < \frac{3\lambda_g}{4\pi} = \frac{3\lambda_o}{4\pi\sqrt{\epsilon_r'}}. \quad (4)$$

In practice, the length, L, and exterior diameter of substrate 20, and the width, $W_1$, of strip conductor 40 determine the number of turns of strip conductor 40. Typically, the former two dimensions are fixed values determined by considerations (e.g., design limitations upon the space available for occupancy by an antenna) irrelevant to the performance of antenna 10. A coating of an electrically conducting material normally identical in composition to the material of strip conductor 40 coats the interior circumferential surface of substrate 20 to define a ground plane 30. As better shown by the partial end view of FIG. 2, ground plane 30 is coupled to strip conductor 40 by an electrical short 50 at one base of cylindrical substrate 20.

Figure 2:
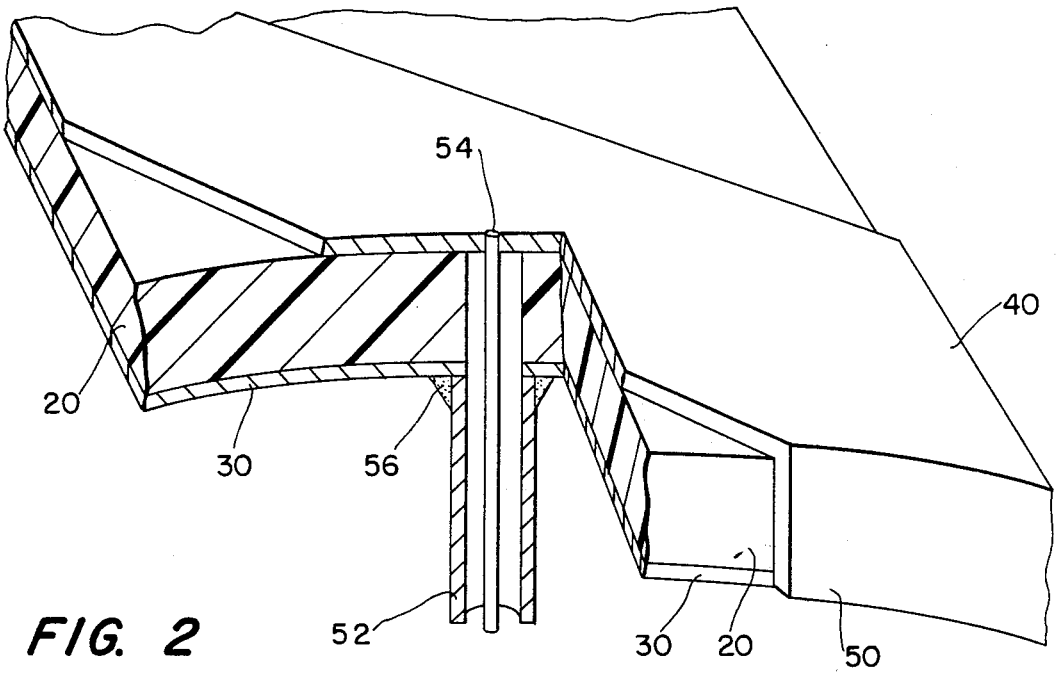
FIG. 2 is a cut-away end view illustrating the attachment of a coaxial cable to the antenna shown in FIG. 1.

Also shown in FIG. 2 is a detail of a coaxial transmission line 52 through which antenna 10 is coupled to a transmitter or receiver. The shield or ground of transmission line 52 is electrically coupled to ground plane 30 by connector 56 (e.g., lead-tin solder) and the inner conductor 54 is passed through (and separated from) ground plane 30, dielectric substrate 20, and coupled to the middle of strip conductor 40. For the typical fifty ohm coaxial transmission line 52, coupling conductor 54 at a position approximately one-fourth of the length of strip conductor 40 from shorted end 50 will provide a matching fifty ohm impedance. Impedance matches less than fifty ohms are obtained by moving the connection closer to the shorted end of the antenna; higher impedances are obtained by moving the connection to the open or radiating end. No tuning capacitors or inductors are necessary.

Figure 3:
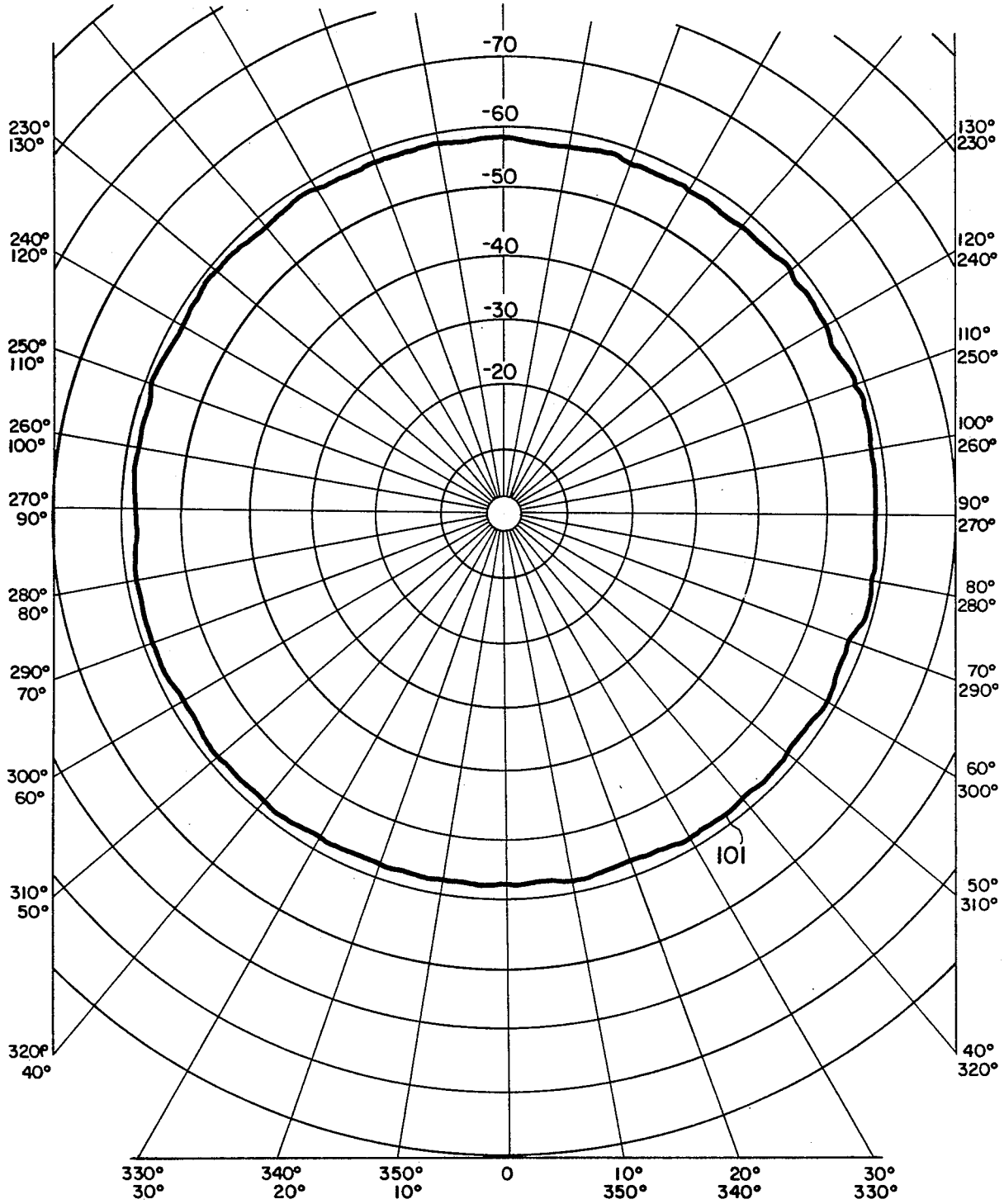
FIG. 3 is an omnidirectional radiation pattern of vertical polarization given by an antenna of the type taught here.

To examine the omnidirectional radiation pattern of an antenna made according to these teachings, an antenna quite similar in structure to that described by FIG. 1 was placed in the center of a ground plane of steel wire screen three hundred by three hundred meters wide. The longitudinal axis of the antenna was perpendicular to the steel wire screen. The antenna was then rotated about its longitudinal axis while coupled to a 41.28 megahertz source with input power set at −12 dBm. FIG. 3 is an almost perfectly circular plot 101 of the vertically polarized signal radiated, measured in azimuth with a dipole located at a distance of one hundred and twelve feet from the longitudinal axis of the strip conductor antenna. At the monitoring antenna the signal was measured at a uniform −57 dBm.

Figure 4:
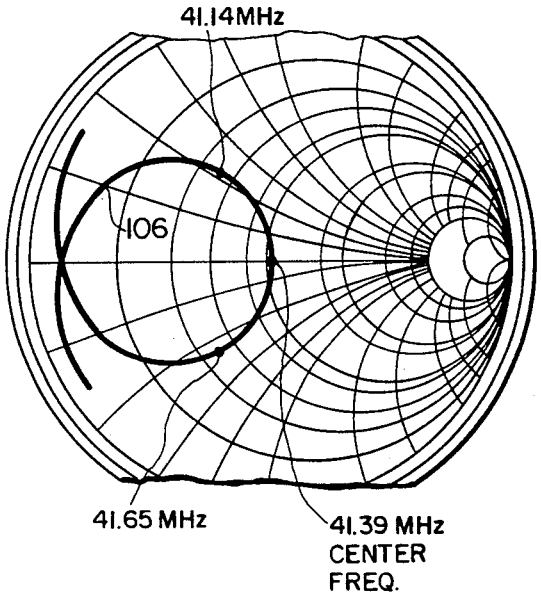
FIG. 4 is a plot on a Smith chart showing the impedance match and bandwidth obtained by one embodiment of an antenna of the type taught here.

A typical Smith chart of the terminal impedance of the omni-microstrip antenna 10 described here, as measured by a network analyzer, is shown as plot 106 in FIG. 4.

EXAMPLE I

One model of the antenna 10 was made with a thirteen inch length (L=13") of a polyvinylchloride ($\epsilon_r \approx 2.3$ at 100 $MH_3$) sewer pipe serving as dielectric substrate 20. The pipe had an outside diameter of 4.50 inches and a wall thickness, h, of 0.25 of an inch. A layer of copper covered the interior circumferential surface of substrate 20 and formed ground plane 30. Quarter wavelength strip conductor 40 was a one hundred and twenty-eight centimeter length of 2.5 inches wide copper wound about three turns as a helical spiral about the exterior circumferential surface of substrate 20 with a pitch of about twenty degrees. Resonant frequency was 41.4 $MH_z$; efficiency, $\eta_r$, was measured at about 1.0%; bandwidth was measured as 0.5 MHz.

EXAMPLE II

Another model of the antenna 10 described by FIG. 1 was made with a styrofoam dielectric ($\epsilon_r \approx 1.07$ at 100 MHz) cylinder serving as dielectric substrate 20. Substrate 20 had an outside diameter of eight inches, a wall thickness, h, of two inches, and an empirically selected length, L, of thirteen inches. A layer of copper covered the interior circumferential surface of substrate 20 and formed ground plane 30. Strip conductor 40 was a 1.9 meter strip of three inch wide (i.e., $W_1$=3.0") copper wound an even three turns as a helical spiral about the exterior circumferential surface of substrate 20. The resulting separation, $W_2$, between adjacent loops of strip conductor 40 was 1.5 inches. The center of the feed port 52 for coaxial electrical connector 54 was located a distance, d, of 3.7 centimeters above electrical short 50. When tested, the antenna exhibited a resonant frequency at 55.0 MHz, an efficiency as defined by equation (12) of 50% −5%, +15%, an impedance match nearly identical to that shown by FIG. 4.

Figure 5:
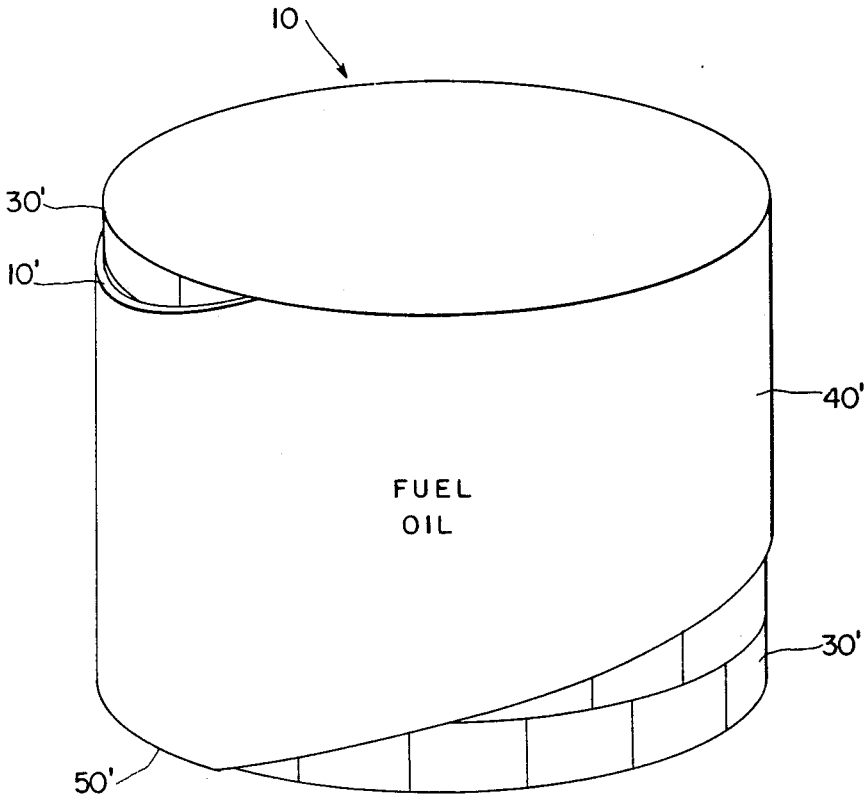
FIG. 5 is an alternate embodiment of the antenna shown in FIG. 1.

In the preceeding paragraphs of this discussion embodiments of the disclosed antenna are physically small. An alternate and larger embodiment, antenna 10, is shown by FIG. 5 where a wide strip conductor 40' is helically wrapped for slightly more than one turn around the exterior circumferential surface of a fuel oil tank 30'. As tank 30' is constructed of electrically conducting steel plates, it serves as a ground plane. A layer 20' of a dielectric material separates the radiating element, strip conductor 40', from ground plane 30'. A steel tank 30' having an outside diameter on the order of twenty feet, for example, could easily support a helically wound quarter wavelength strip conductor of seventy-five feet length. This is sufficient length to provide service in the high frequency (i.e., 3 to 30 megahertz), band for such uses as fixed radio communication between mobile receiver. A larger steel tank, perhaps on the order of three hundred feet in diameter, could support the slightly more than one turn of a one thousand foot helically wound, quarter wavelength strip conductor necessary for service in the medium frequency (i.e., 300 to 3,000 kilohertz) band. Comparison of this embodiment with those previously discussed illustrates that the layer 20, 20' of dielectric material need not be coextensive with the exterior circumferential surface of ground plane 30. Furthermore, ground plane 30 may be simply a skin depth layer of an electrically conducting material such as electroplated copper or may be an existing structural member such as a solid rod such as rotating shaft.

From the foregoing teachings, it is apparent that the omni-microstrip antenna disclosed provides more advantages than an omnidirectional radiation pattern, such as an electrically short axial length, L. As the inside of the antenna is a closed surface formed by electrically conductive ground plane 30, anything placed inside the cylinder will not affect performance of the antenna and conversely, will be shielded from antenna fields. Placement of the strip conducting 40 in a helical spiral around the supporting dielectric (or the ground plane, if that element actually provides support for the other elements as ground plane 30' does in FIG. 5), has the effect of reducing the height, L, of the antenna.

The length of the antenna is given approximately by:

$$L = \frac{\lambda_g}{4} = \frac{\lambda_o}{4\sqrt{\epsilon_r'}} \quad (5)$$

By definition, $$\epsilon_r' = 1 + q(\epsilon_r - 1) \quad (6)$$

where q is the filling factor given by A. Presser in R.F. Properties Of Microstrip Lines, in the March, 1968 issue of Microwaves.

The bandwidth of the antenna arises from three sources of loss to the resonator: the desired radiation loss $P_Z$, the dielectric loss of the substrate $P_D$, and the resistive loss of the metallic conductors (e.g., strip conductor 40) $P_R$.

$$P_Z = \frac{2300\pi\, h^2}{\lambda_o^2\, Z_o\, \epsilon_r'} \quad (7)$$

$$P_D = \frac{q\, \epsilon_r \tan\delta}{\epsilon_r'} \quad (8)$$

$$P_R = \frac{\lambda_o\, (f_o\rho)^{\frac{1}{2}}}{1580\, Z_o\, w\, \epsilon_r} \quad (9)$$

where $$Z_o(\text{ohms}) = \frac{120\,\pi\, h}{\sqrt{\epsilon_r}\, W_1\left[1 + 1.74\,\epsilon_r^{-0.0724}\left(\frac{W_1}{h}\right)^{-0.836}\right]} \quad (10)$$

$f_o$ is the center frequency of operation in hertz,
h is the dielectric thickness in meters,
$W_1$ is the width of strip conductor 40 in meters,
$\rho$ is the conductivity of the conductors 30, 40 in ohms/meter,
tan $\delta$ is the loss tangent of the dielectric material.

Taken together, these three factors influence bandwidth according to:

$$\Delta f(H_z) = f_o \bullet [P_Z + P_D + P_R] \quad (11)$$

Efficiency of antenna 10, 10' is the ratio between the amount of power radiated to the losses incurred and can be calculated using the previously defined variables as:

$$\eta(\%) = \frac{100}{\left[1 + \frac{Z_o q\, \epsilon_r \tan\delta}{2300(h/\lambda_o)^2} + \frac{\lambda_o^3 (f_o \rho \epsilon'_r)^{\frac{1}{2}}}{1.15 \times 10^7 h^2\, W_1}\right]} \quad (12)$$

The second and third terms in the denominator represent the dielectric and resistive losses, $P_D$ and $P_R$ respectively, normalized to the radiation loss.

To maximize antenna bandwidth and efficiency simultaneously at a given frequency, the width, $W_1$, of strip conductor 40 should be made a wide as possible, the material from which substrate 20 is made should have a dielectric constant, $\epsilon_r$, as nearly equal to one as can be obtained, and the thickness, h, of substrate 20 should be made as great as possible. The constraints on these variables are due to both physical characteristics of the materials used and the system prescribed. For example, the value of the lowest relative dielectric constant available equals one; the value of $W_1$ is restricted by the allowable antenna size; the value of h is limited to prevent the existance of higher order modes.

The material variables describing antenna losses are dielectric loss, tan $\delta$, and resistivity, $\rho$, of the metal conductors 30, 40 A decrease in either, at least for a few skin depths at $f_o$, results in an increase in efficiency at the expense of a decrease in bandwidth. At one extreme, where the values of tan $\delta$ and $\rho$ approach zero, all antenna designs approach one hundred percent efficiency. The bandwidth is then given by:

$$\Delta f(Hz) = \frac{19.2\, W_1 h\, f_o}{\sqrt{\epsilon_r}\, \lambda_o^2}. \quad (13)$$

This leaves variables $W_1$, h, and $\epsilon_r$ to adjust the bandwidth. The values of $W_1$ and h affect the length of antenna 10 by determining the value of filling factor q; the value of $\epsilon_r$ affects the length of the quarter wave resonator 40. A figure of merit incorporating both efficiency and bandwidth is given by the equation:

$$\frac{\Delta f}{f_o} \times \eta = \frac{19.2\, W_1 h \sqrt{\epsilon_r}\, [1 + 1.735\, \epsilon_r^{-0.0724}\, (W_1/h)^{-0.836}]}{\lambda_o^2\, \epsilon'_r} \quad (14)$$

At any frequency, the variable $W_1$ and h will be scaled along with the resonant wavelength, $\lambda_o$. Therefore, the product $W_1h$ tends to cancel the influence of $\lambda_o^2$, leaving the figure of merit independent of frequency. Accordingly, the disclosed omni-microstrip antenna will operate equally well at any frequency and is not restricted to the high frequency band.

While the capacitance in a dipole lies between the dipole and the ground (typically, the earth) and varies with the length of the dipole, the capacitance in the omni-microstrip antenna occurs predominately between strip conductor 40 and groundplane 30 and is therefore uniformly distributed over the circumferential surface of the antenna. A distributed capacitance means that omni-microstrip antenna suffers less detuning when placed in an environment other than the atmosphere (e.g., when operated underwater).

What is claimed as new and desired to be secured by Letters Patent of the United States is:

1. An omnidirectional antenna, comprising:
a hollow right circular cylinder of a non-conducting material;
an electrically conducting medium covering the interior circumferential surface of the cylinder;
a strip conductor of uniform width spiraling to a narrow taper wound as an open loop about the exterior cylindrical surface of the cylinder and adapted to be connected to a feedline;
means for electrically coupling the coating at one base of the cylinder to the strip conductor.

2. An omnidirectional antenna, comprising:
a strip of an electrical conductor describing an open loop and adapted to be connected to a feedline;
an exterior cylindrical surface of an electrically conducting material;
a layer of a non-conducting material separating the strip from the exterior cylindrical surface; and
means for electrically shorting an end of the strip to the electrically conducting material.

3. The antenna set forth in claims 1 or 2, further comprising the strip conductor being wound parallel to a plane perpendicular to a central axis of the cylindrical surface.

4. The antenna set forth in claims 1 or 2, further comprising the strip conductor being helically wound about the cylindrical surface.

5. The antenna set forth in claims 1 or 2, further comprising:

the non-conducting material having a dielectric constant relative to air of less than $10^6$.

6. The antenna set forth in claim 4, further comprising:

the strip having a width and describing more than one loop around the exterior cylindrical surface.

7. The antenna set forth in claim 4, further comprising:

the strip having a width and describing more than one loop around the exterior cylindrical surface, adjacent loops being spaced apart by a distance not less than one half of the width.

8. The antenna set forth in claim 4, further comprising:

the strip describing less than one loop around the exterior cylindrical surface.

* * * * *